United States Patent [19]

Evenson

[11] Patent Number: 5,067,628

[45] Date of Patent: Nov. 26, 1991

[54] DISPENSER FOR NOTE PAD SHEETS

[76] Inventor: Mel Evenson, c/o Eldon Industries, Inc., 9920 La Cienega Blvd., P.O. Box H-130, Inglewood, Calif. 90301

[21] Appl. No.: 546,416

[22] Filed: Jun. 29, 1990

[51] Int. Cl.[5] ..... B65H 1/00

[52] U.S. Cl. ..... 221/52; 221/56; 221/61

[58] Field of Search ..... 221/33, 45, 52, 53, 221/54, 56, 61, 312 R, 279, 268

[56] References Cited

U.S. PATENT DOCUMENTS

| | | | |
|---|---|---|---|
| 1,702,983 | 2/1929 | Shaffer et al. | 221/45 |
| 2,253,742 | 8/1941 | West et al. | 221/61 |
| 3,606,082 | 9/1971 | Kuctenbecker | 221/52 |
| 4,416,392 | 11/1983 | Smith . | |
| 4,586,631 | 5/1986 | Loder | 221/61 |
| 4,781,306 | 11/1988 | Smith | 221/33 |
| 4,796,781 | 1/1989 | Windorski . | |
| 4,921,127 | 5/1990 | Windorski . | |
| 4,986,440 | 1/1991 | Windorski | 221/45 |
| 4,993,590 | 2/1991 | Windorski | 221/45 |

*Primary Examiner*—H. Grant Skaggs
*Attorney, Agent, or Firm*—Joseph C. Andras

[57] ABSTRACT

An improved dispenser for dispensing note sheets from a pad of note sheets that are releasably adhered to one another with a narrow strip of adhesive on opposite alternative edges thereof. The dispenser includes a base member for supporting the pad of note sheets and a lid member supported from the base member at a fixed distance relative thereto. The dispenser further includes a movable weighted member located between the base member and the lid member so as to rest upon the top of the note pad and a guide member being provided to restrain the weighted member between the base member and the lid member during a dispensing operation or upon mishandling of the dispenser. The base member and lid member may constitute a full enclosure and be releasably locked to one another.

10 Claims, 6 Drawing Sheets

DISPENSER FOR NOTE PAD SHEETS

BACKGROUND OF THE INVENTION

1. Field of the Invention

The present invention relates generally to desk accessories and, more particularly, to a new dispenser for dispensing note sheets that are releasably adhered to one another in a stack and on alternate opposite edges thereof.

2. Description of Related Art

The present invention relates to an improved refillable dispenser for dispensing sheets from a note pad in which a repositionable pressure-sensitive adhesive coating on each successive sheet in the pad is disposed along alternate opposite sides of the pad in a fan fold or accordion-like fashion.

One of the first known dispensers intended for this purpose is disclosed in U.S. Pat. No. 4,416,392, issued on Nov. 22, 1983. Disclosed therein is a dispenser comprised of a box having a slot centrally disposed in the top of the box and parallel to the edges of the sheets coated with adhesive. An alternative embodiment is disclosed comprising a base and a removable cover for supporting a stack of adhesive sheets therebetween, and further including a spring member between the base and the bottom of the sheets to urge the sheets towards an opening provided in the removable cover. The slots of both disclosed dispensers have sharp edges which tend to cause the sheets to develop a curl when pulled past these edges.

A later dispenser, disclosed in U.S. Pat. No. 4,653,666, comprises a box member which fits about a stack of sheets and has a centrally disposed opening parallel to the edges coated with adhesive. As before, a spring member is used to urge the sheets towards the opening. Extending from the top wall of the box and into the opening are flexible flaps that define an arcuate wall on which the sheets are pulled over as they are dispensed. Thus, this dispenser avoided the development of curl in the sheets. However, this dispenser lacks certain advantages. Specifically, it is not refillable and is not suitable for one-handed desk top operation because of its light weight.

Subsequently, U.S. Pat. No. 4,796,781 discloses a dispenser that combines the benefits of providing an arcuate wall along the interior edges of the slot parallel to the adhesive edges of the sheets to reduce curl, along with adequate weight to provide one-handed desk top operation. The dispenser disclosed therein is a two-piece dispenser comprised of a base for supporting a pad of note sheets and a weighted body having a slot with arcuate side walls centrally located therein. The weighted member allows for one-handed operation by preventing the entire dispenser from being unduly subject to movement during a dispensing operation. The weighted member also serves to slightly restrain the adhesive edges of the sheets so that the resistance to pull tends to individually separate the sheets during a dispensing operation.

Although the dispenser disclosed in U.S. Pat. No. 4,796,781 constituted an advancement in the art, it created other disadvantages. In particular, if the user attempts to dispense a note sheet with excessive force, the slotted body member may be separated from the base, requiring a subsequent reloading operation and possibly damaging the surface on which the dispenser rests. In addition, the base and body member may separate if the dispenser is carelessly lifted or moved about the desk by a user. Finally, because the body member rests directly on top of the pad of note sheets, the vertical height of the dispenser changes as the height of the pad changes.

U.S. Pat. No. 4,921,127, a continuation-in-part of U.S. Pat. No. 4,796,781 described above, discloses additional embodiments of two-piece dispensers. However, each of the additional embodiments suffers from the same infirmities. Specifically, the upper weighted body members may be separated from the base upon careless handling of the dispenser or from enthusiastic dispensing of sheets.

The present invention provides a dispenser for adhesive-coated accordion-like note sheets that does not leave a curl in the paper, is of sufficient weight for one-handed operation, does not change height externally as the height of the pad of note sheets decreases, and is refillable, yet not generally subject to accidental component separation from careless handling or spirited dispensing.

SUMMARY OF THE INVENTION

The present invention is a dispenser intended for use in dispensing note sheets from a pad of note sheets releasably adhered to one another with narrow strips of adhesive on opposite alternative edges thereof. The dispenser comprises a base member, an upper member having a slot centrally located therein, and means for supporting the upper member at a fixed distance relative to the base member. The dispenser is further comprised of a weighted member disposed between the base member and the upper member, the weighted member being movable relative to the base member and the upper member and adapted to rest on the top sheet of a note pad supported by the base member.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a new note sheet dispenser.

Figure 1:
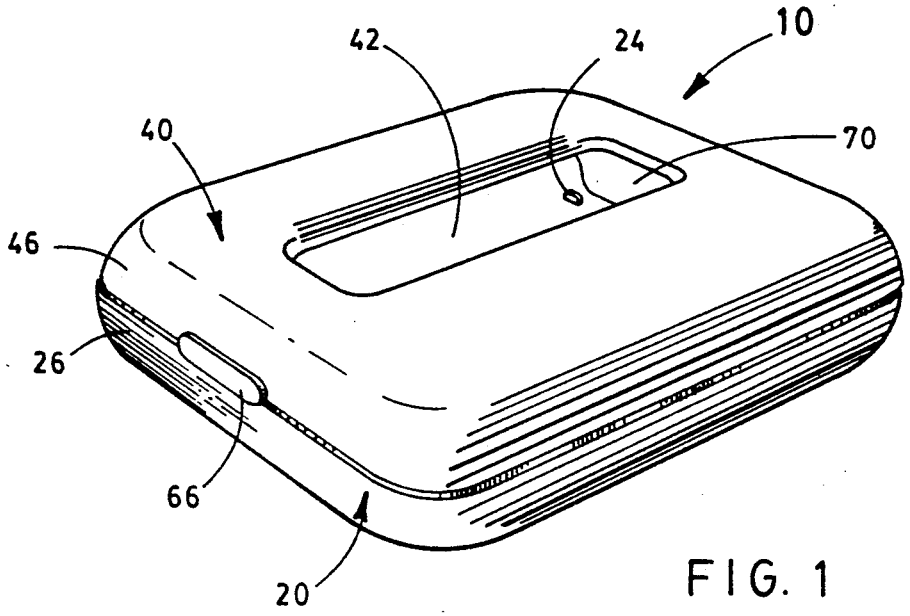
FIG. 1 is a perspective view of a preferred embodiment of a dispenser according to the present invention.

Referring to FIGS. 1 through 6, there is disclosed a first preferred dispenser 10 according to the present invention and components thereof. Referring to FIG. 1, the dispenser 10 is generally comprised of a base member 20 and a lid member 40 having a slot 42 centrally located therein. As shown, the base member 20 has an upwardly-extending peripheral wall 26 that operatively engages with a downwardly-extending peripheral wall 46 of the lid member 40 in order to form an enclosure. The teachings of the present invention may, of course, be practiced without provision of a full enclosure. The base member 20 and lid member 40 may be made of any variety of materials and using any variety of manufacturing methods, the preferred method for the design depicted in FIG. 1 being injection molded plastic. The actual exterior design of the dispenser 10 is not a material consideration in the utility of the present invention, and many variations are, of course, possible.

Figure 2:
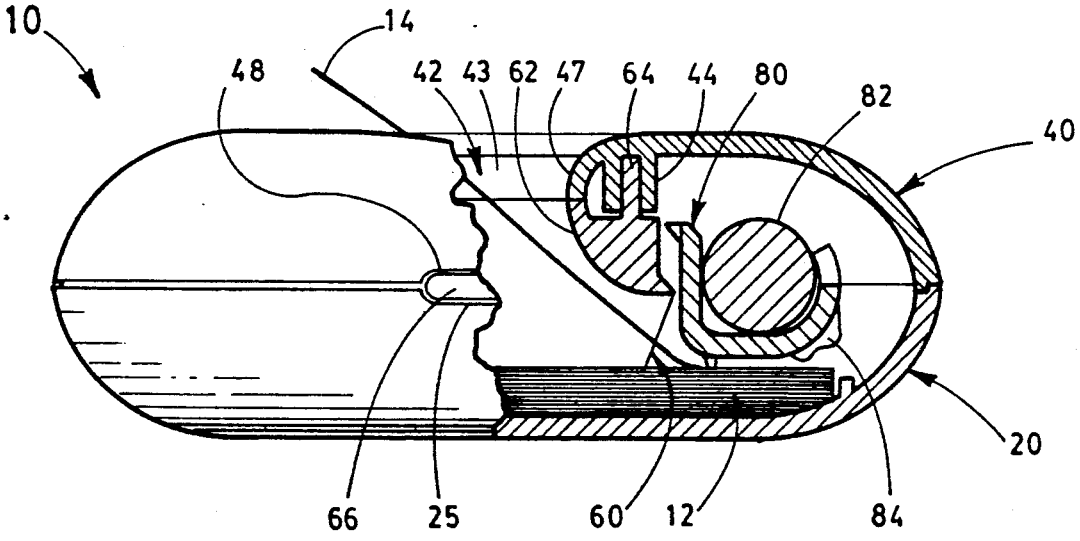
FIG. 2 is a side elevational view, partly in section, of the dispenser of FIG. 1.

As mentioned earlier, the dispenser 10 of the present invention is intended to dispense note sheets 14 from a pad 12 comprised of a plurality of note sheets adhesively held to one another with a narrow strip of releasable adhesive on opposite alternative edges thereof. Such a pad of note sheets might be thought of as a zigzag or accordion-like structure. Referring to FIG. 2, it can be seen that the note sheet pad 12 is supported by a bottom section 21 of base 20, and that the first preferred dispenser is further comprised of a weighted member 80 and a slotted guide member 60.

Figure 3:
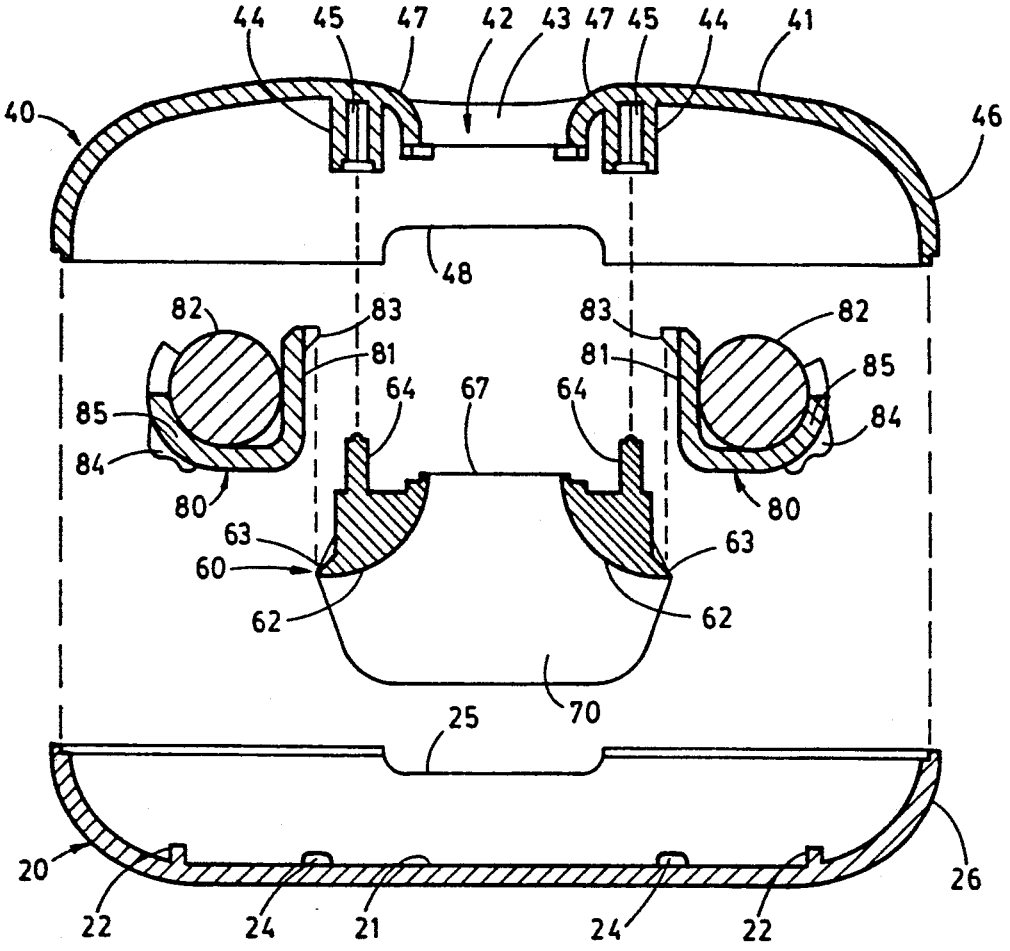
FIG. 3 is an exploded sectional side elevational view of the dispenser of FIG. 1.

The operative relationship between the components of this first preferred dispenser are probably best understood by reference to FIG. 3. Referring to FIG. 3, base member 20 is comprised of a bottom section 21 and an upwardly-extending perimetric wall 26. A plurality of tabs 22, 24 extend upward from bottom section 21 in order to define a region in which note pad 12 may be placed and horizontally restrained during handling or during a dispensing operation.

As suggested by FIG. 3 and shown in FIG. 2, the lid member 40 carries the support member 60 which, in turn, carries the weighted member 80, the lid member 40 then being connected to the base member so as to form a full enclosure. The guide member 60 includes a plurality of posts 64 for connection to a plurality of hexagonal apertures 45 carried by the lid 40. The weighted member 80 has receptacles 85 disposed on both sides of the guide member 60 in such fashion that the weighted member 80 may move up or down relative to the guide member 60. The weighted member 80 includes a pair of inwardly-extending stop members 83 that are dimensioned to rest on a pair of corresponding shoulders 63 carried by guide member 60.

The lid member 40 is comprised of a top section 41 and a perimetric wall 46 extending downwardly therefrom. Lid member 40 further includes a dispensing slot 42 located centrally on said top section 41, said dispensing slot 42 having arcuate side walls 47 and arcuate end walls 43. A plurality of protrusions 44 carrying hexagonal apertures 45 are disposed on opposite sides of the slot 42.

Figure 6:
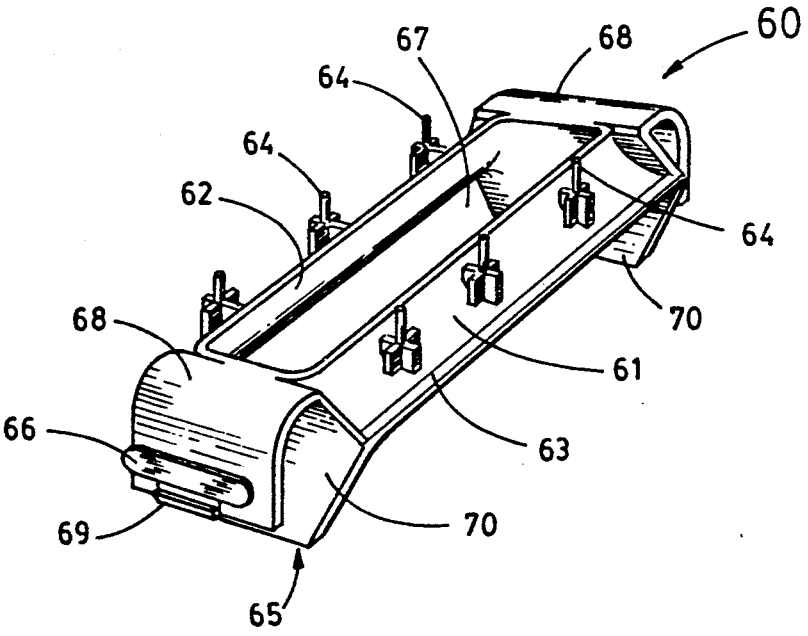
FIG. 6 is a perspective view of a support member 60 having a slot with arcuate side walls for dispensing note sheets therethrough, and parallel shoulders disposed on opposite longitudinal sides thereof on which the weighted member of FIG. 5 may rest.

The guide member 60 will now be described with reference to FIGS. 3 and 6. As shown, guide member 60 is comprised of a central body 61 which carries a guide slot 67 along its length. A plurality of cylindrical members 64 extend upwardly from the central body 61 and are geometrically arranged to align with the corresponding plurality of hexagonal apertures 45 carried by the lid member 40. The use of cylindrical members and hexagonal apertures is a common method of providing a press fit assembly. When the guide member 60 has been fitted to the lid member 40, the guide slot 67 is substantially aligned with the dispensing slot 42, as shown in FIG. 2. A pair of parallel opposed arcuate side walls 62 are provided on opposite sides of guide slot 67 and oriented so as to be parallel to the releasable adhesive carried by the note sheets 12 to be dispensed. The arcuate side walls 62 provide a smoothly curved surface over which a note sheet 14 is pulled during a dispensing operation, and are so provided to minimize the stress placed on the paper during such operation. The curved walls 43, 47 surrounding the dispensing slot 42 carried by the lid member 40 complement the operation of the arcuate side walls 62 by providing a smooth surface over which a note sheet 14 may be pulled if an operator dispenses a sheet to one side or the other, as opposed to the preferred method of straight up. A pair of curved flexible end-members 68 extend from the central body 61 on either end of the guide slot 67. Each of the curved flexible end-members 68 carries a protrusion 66 and a hook member 69, the operation of which will be described further herein. The guide member 60 further includes a pair of shoulders 63 which extend longitudinally along the central body 61 on opposite sides of the guide slot 67.

Figure 5:
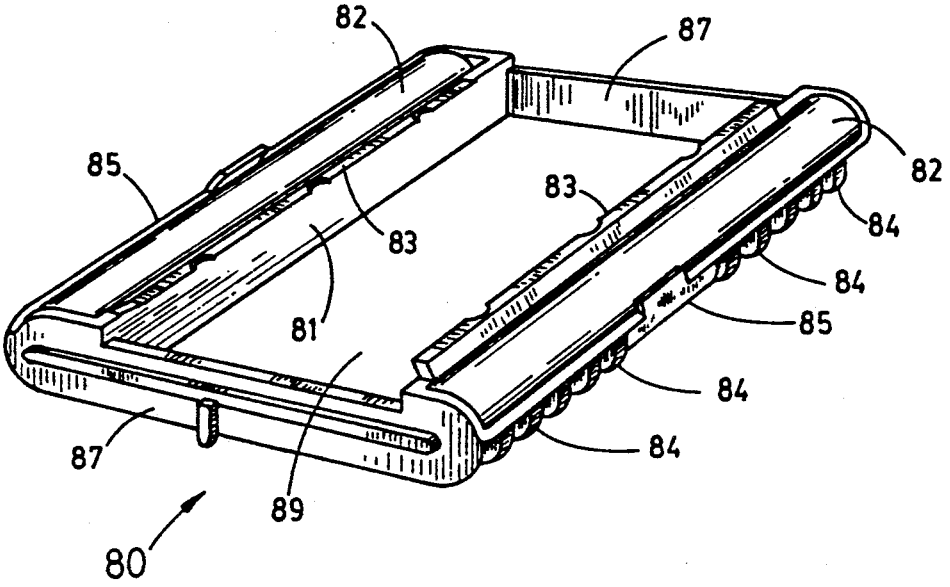
FIG. 5 is a perspective view of the weighted member 80 used with the dispenser of FIG. 1.
Figure 7:
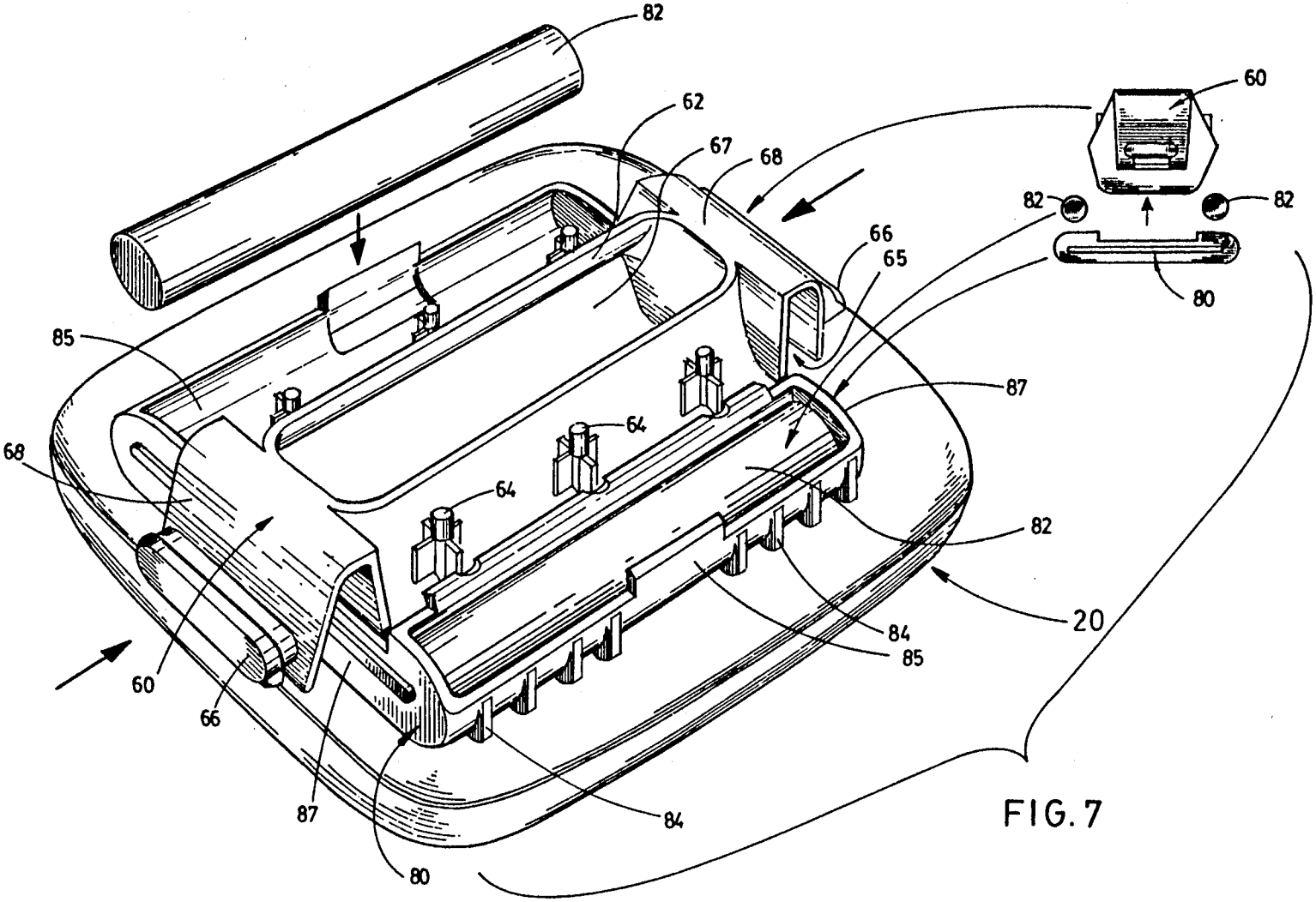
FIG. 7 is a perspective view of the dispenser of FIG. 1 with the lid member removed.

With reference to FIGS. 3 and 5, the weighted member 80 is shown to be comprised of a pair of parallel spaced longitudinal receptacles 85 connected to one another by connecting members 87. In the preferred embodiment, the weighted member 80 is fashioned from plastic, and the receptacles 85 are provided in order to support a pair of cylindrical metal slugs 82, which add the necessary weight to weighted member 80. The weighted member 80, instead of being injection molded plastic with steel plugs 82, may, of course, be entirely comprised of die cast steel or other suitable construction. It can be further seen that the receptacles 85 include vertical side walls 81 from which the stop members 83 extend inwardly. The spaced distance between opposite side walls 81 is such that the weighted member 80 may fit around and move up or down relative to the central body 61 of guide member 60. As best shown in FIG. 3, the inwardly-extending stop members 83 are positioned so as to rest on the shoulders 63 provided on the guide member 60 when the weighted member 80 is in a fully down position relative to the guide member 60. As shown in FIG. 7, when the weighted member 80 and the guide member 60 are operatively connected to one another, the connecting members 87 occupy a space 65 between central body 61 and curved flexible end-members 68.

Weighted member 80 further includes a plurality of ribs 84 which protrude downwardly from the receptacles 85. As shown in FIG. 2, the ribs 84 concentrate the application of the downward force provided by weighted member 80 onto the note pad 12, beneficially reducing the amount of weight necessary for proper dispensing and reducing the amount of force that must be exerted in removing a note sheet 14.

Figure 4:
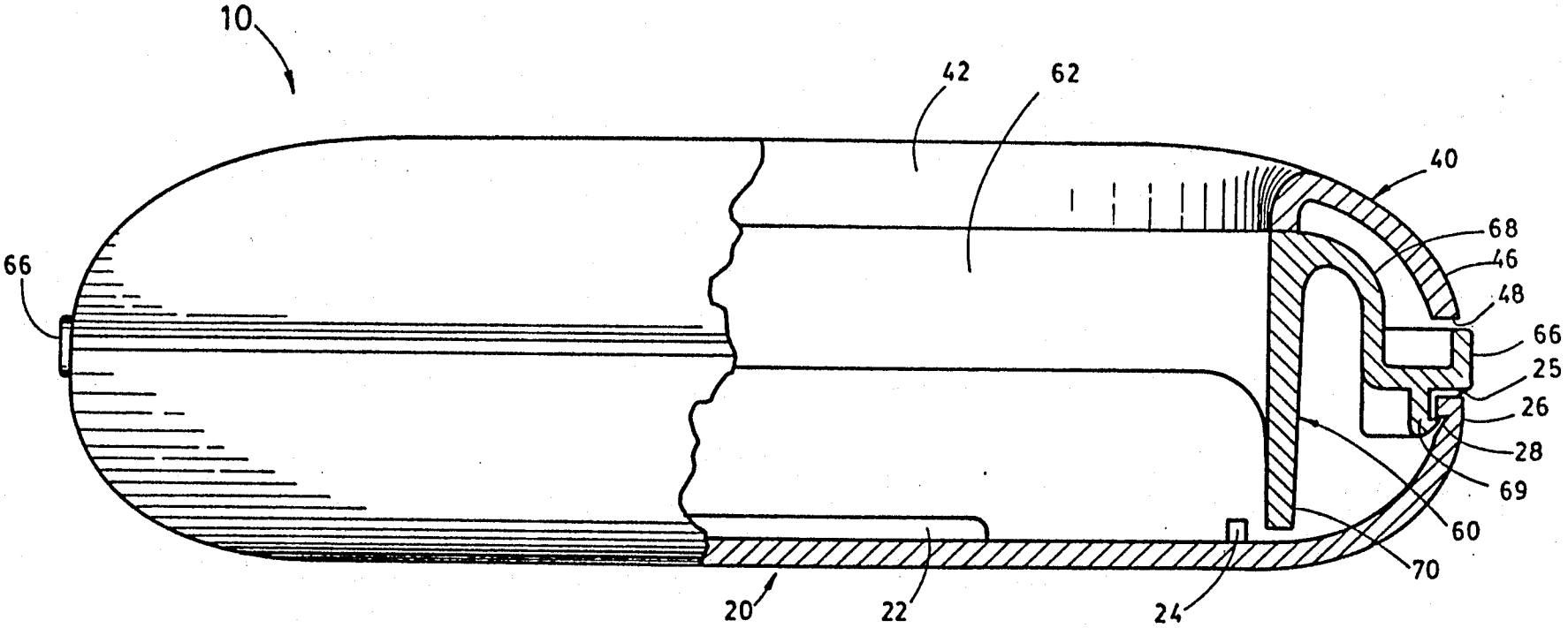
FIG. 4 is a side elevational view, partly in section, of the dispenser of FIG. 1, with weighted member 80 being omitted for clarity.

A further advantage of the dispenser depicted in FIG. 1 is that the lid member 40 is releasably locked to the base member 20 so that there is little risk of the components separating from one another if dropped or carelessly handled, or if a note sheet 14 is energetically dispensed. The preferred locking mechanism is disclosed in FIG. 4, which is a partial cutaway of the dispenser of FIG. 1, with the weighted member having been removed therefrom for clarity. As shown in FIG. 3, base member 20 is provided with a pair of notches 25 disposed on opposite sides of perimetric wall 26, and lid member 40 is provided with a corresponding pair of notches 48 disposed on opposite sides of perimetric wall 46. As shown in FIG. 4, the notches 48, 25 provide apertures through which the protrusions 66 may extend. A pair of outwardly-extending hook members 69 are provided on the flexible end-members 68 which protrude from the central body 61 of guide member 60. The hook members 69 operatively engage with the notches 28 provided on the inside of the perimetric wall 26 of base 20.

As disclosed earlier, the guide member 60 is carried by the lid member 40. Thus, locking the guide member 60 to base member 20 also locks the lid member 40 to the base member 20. When the lid member and guide member 60 are pressed downward onto the base member 20, the curved end-members 68 first flex inward as hook members 69 glide over the inside edge of perimetric wall 26, and then flex outward to engage hook members 69 with notch 28. When necessary to refill the dispenser, an operator simply presses the protrusions 66 on opposite sides of dispenser 10 in order to release the lid member 40 from base member 20.

Figure 8:
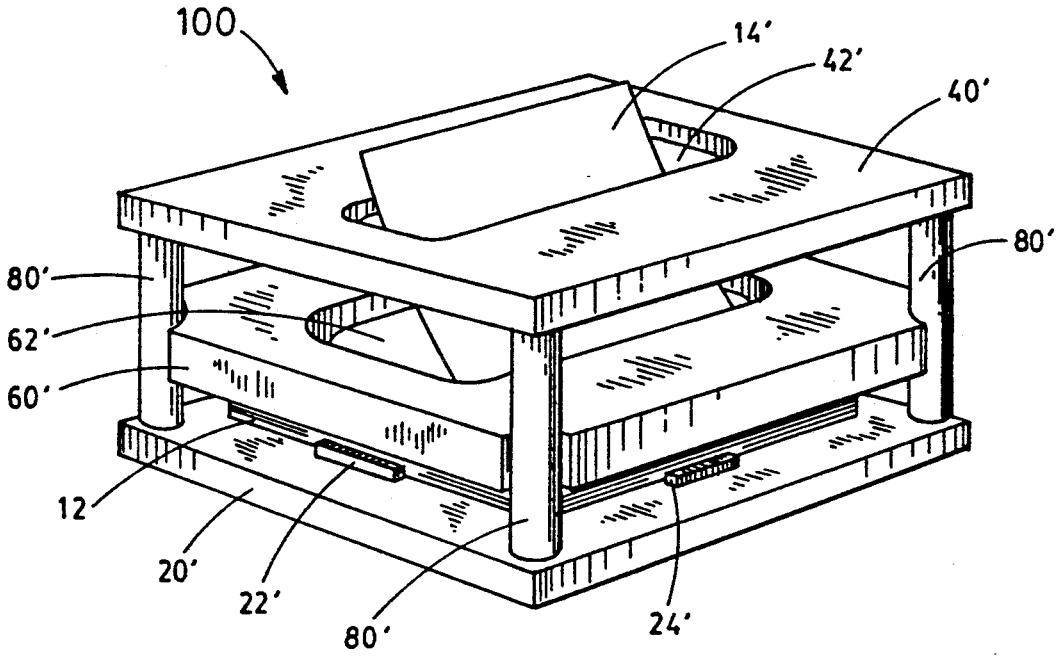
FIG. 8 is a perspective view of an alternative embodiment of a dispenser according to the present invention.

An alternative embodiment of a dispenser according to the present invention is depicted in FIG. 8. To the extent possible, the components of the dispenser depicted in FIG. 8 that are the functional equivalents of the components of the first preferred embodiment have been referenced with the same numerals including a prime designation. As shown, the dispenser 100 is comprised of a base member 20' which supports a pad 12 of note sheets 14, said pad 12 being horizontally restrained by a plurality of tab members 22', 24'. A lid member 40' is supported above the base member 20' and at a fixed distance therefrom by posts 80' which, as further explained herein, also serve as guide members. Lid member 40' further includes a dispensing slot 42' through which an operator may pull a note sheet 14. Disposed between base member 20' and lid member 40' is a weighted member 60' having a slot 62' centrally located therein. The weighted member 60' is movably supported between base member 20' and lid member 40' with the guide means 80', as shown.

As with the first preferred embodiment, the dispenser of FIG. 7 beneficially provides a dispenser having sufficient weight to allow one-handed operation that is both refillable and not subject to potential component separation from mishandling or excessive pulling force on note sheet 14.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A disperser comprising:

a base member for supporting fan-folded notes;

a lid member;

means for releasably connecting the base member and lid member to one another so that the base member and lid member are spaced from one another and form an enclosure to receive and enclose the fan-folded notes;

means for dispensing the fan-folded notes one at a time from the enclosure;

a weighted member located within the enclosure and positioned to contact the top of the fan-folded notes, the weighted member being movable relative to the base member and lid member as the fan-folded notes are individually removed, said weighted member being comprised of a pair of spaced weight elements that are connected to one another by a pair of connecting members so as to define an aperture therebetween, and a guide member connected to said lid member and extending downward into said enclosure, said guide member including a central body and a second slot centrally located therein so as to be substantially aligned with said first slot, said central body being dimensioned such that the aperture of said weighted member may encompass said central body and move up and down relative to said guide member.

2. A dispenser for dispensing individual note sheets from a pad of fan-folded adhesive note sheets, said dispenser comprising:

a base;

means for supporting said pad;

a lid including a dispensing slot through which said notes may be pulled one-by-one from said pad;

means for supporting said lid above said base and at a fixed distance relative thereto;

a weighted member, said weighted member being provided between said base and said lid and being biased against an upper note of said pad, said weighted member having sufficient mass to substantially prevent said dispenser from being lifted from a supporting surface when a note sheet is pulled through said dispensing slot; and guide means for movably restraining said weighted member between said base and said lid whereby said weighted member may move downward and remain biased against the upper note of said pad as said notes are pulled through said dispensing slot.

3. The dispenser of claim 2 wherein said weighted member is comprised of a metal plate having a slot centrally located therein.

4. The dispenser of claim 2 wherein said weighted member includes a plurality of protrusions having a smaller surface area than the overall weighted member, said protrusions contacting said pad such that the weight of said weighted member is concentrated over the smaller surface area of said protrusions.

5. The dispenser of claim 2 wherein said guide means is a longitudinal support member having a guide slot that is substantially aligned with said dispensing slot and a peripheral wall that defines a pair of support shoulders that extend along opposite sides of said guide slot.

6. The dispenser of claim 5 wherein said weighted member is comprised of a plurality of peripheral members that define a sliding aperture that makes a sliding fit with the peripheral wall of said longitudinal support member such that said weighted member may move up and down along the peripheral wall of said longitudinal support member.

7. The dispenser of claim 6 further comprising:

means for suspending said longitudinal support member from said lid; and means for retaining said weighted member on said longitudinal support member.

8. The dispenser of claim 7 wherein said means for retaining is comprised of a plurality of stop members which extend inwardly into said sliding aperture from said peripheral members, said stop members coming to rest on said support shoulders when said weighted members moves down.

9. The dispenser of claim 7 wherein said means for suspending is comprised of a plurality of cylindrical members extending from said longitudinal support member and a corresponding plurality of hexagonal apertures provided on said lid, said cylindrical members and said hexagonal apertures being dimensioned such that a pressure fit exists therebetween.

10. A dispenser for dispensing note sheets that are provided in a stack wherein each sheet is provided with a narrow adhesive backing along one surface and one edge thereof and wherein adjacent note sheets have the narrow adhesive backing provided along alternate opposite edges thereof, the dispenser comprising:

a base member having a bottom portion and a peripheral wall extending vertically upward from the bottom portion;

a lid member having a top portion with a dispensing slot disposed centrally therein and a peripheral wall extending vertically downward from the top portion, the peripheral wall of the base member supporting the peripheral wall of the lid member so as to define an enclosure between the base member and the lid member;

means for releasably connecting said lid member to said base member;

an internal guide member having a peripheral wall and a guide slot defined centrally therein;

means for suspending the internal support member from the lid member and within the enclosure such that the guide slot is substantially aligned with the dispensing slot;

a weighted member having an internal slot centrally defined therein, the internal slot being dimensioned such that the weighted member may surround and slide up and down relative to the peripheral wall of the internal support member; and means for limiting the downward motion of the weighted member relative to the support member;

whereby the weighted member may slide up and down relative to the support member and continuously contact the top of the stack of note sheets as individual note sheets are dispensed through the internal slot of the weighted member, through the guide slot of the internal support member, and through the dispensing slot of the lid member.

* * * * *